US005528271A

United States Patent [19]

Ebisawa

[11] Patent Number: 5,528,271

[45] Date of Patent: Jun. 18, 1996

[54] INK JET RECORDING APPARATUS PROVIDED WITH BLOWER MEANS

[75] Inventor: Isao Ebisawa, Tokyo, Japan

[73] Assignee: Canon Kabushiki Kaisha, Tokyo, Japan

[21] Appl. No.: 479,188

[22] Filed: Jun. 7, 1995

Related U.S. Application Data

[63] Continuation of Ser. No. 147,423, Nov. 5, 1993, abandoned, which is a continuation of Ser. No. 974,306, Nov. 10, 1992, abandoned, which is a continuation of Ser. No. 498,280, Mar. 23, 1990, abandoned.

[30] Foreign Application Priority Data

Mar. 24, 1989 [JP] Japan ..... 1-73015

[51] Int. Cl.[6] ..... B41J 2/01

[52] U.S. Cl. ..... 347/34; 347/102

[58] Field of Search ..... 347/102, 155, 347/212, 34

[56] References Cited

U.S. PATENT DOCUMENTS

| | | | |
|---|---|---|---|
| 3,854,399 | 12/1974 | Keur et al. | 101/1 |
| 4,313,124 | 1/1982 | Hara | 346/140 R |
| 4,340,893 | 7/1982 | Ort | 346/101 |
| 4,345,262 | 8/1982 | Shirato et al. | 346/140 R |
| 4,361,845 | 11/1982 | Smith | 346/140 R |
| 4,369,450 | 1/1983 | Iwagami et al. | 346/75 |
| 4,371,881 | 2/1983 | Bork et al. | 346/140 R |
| 4,459,600 | 7/1984 | Sato et al. | 346/140 R |
| 4,463,359 | 7/1984 | Ayata et al. | 346/140 R |
| 4,467,348 | 8/1984 | Fujii et al. | 347/3 |
| 4,558,333 | 12/1985 | Sugitani et al. | 346/140 R |
| 4,591,869 | 5/1986 | Katerberg et al. | 346/1.1 |
| 4,668,959 | 5/1987 | Jochimsen et al. | 346/1.1 |
| 4,723,129 | 2/1988 | Endo et al. | 346/1.1 |
| 4,740,796 | 4/1988 | Endo et al. | 346/1.1 |
| 4,811,038 | 3/1989 | Gordon et al. | 346/140 R |
| 4,825,229 | 4/1989 | Matsumoto et al. | 346/1.1 |
| 4,829,324 | 5/1989 | Drake et al. | 346/140 R |
| 4,982,207 | 1/1991 | Tunmore et al. | 346/138 |

FOREIGN PATENT DOCUMENTS

| | | | |
|---|---|---|---|
| 54-156536 | 12/1979 | Japan . | |
| 54-156537 | 12/1979 | Japan . | |
| 0072461 | 4/1983 | Japan | 346/140 PD |
| 59-123670 | 7/1984 | Japan . | |
| 59-138461 | 8/1984 | Japan . | |
| 0087054 | 5/1985 | Japan | 346/75 |
| 0109645 | 5/1987 | Japan | 346/140 R |
| 0130863 | 6/1987 | Japan | 346/140 PD |
| 62-218134 | 9/1987 | Japan . | |
| 199649 | 8/1988 | Japan | 346/75 |

*Primary Examiner*—N. Le

*Attorney, Agent, or Firm*—Fitzpatrick, Cella, Harper & Seinto

[57] ABSTRACT

An ink jet recording apparatus comprises an ink jet recording head having a plurality of discharge portions for discharging ink droplets therethrough, a recording medium conveyor for conveying a recording medium to which the ink droplets adhere and for positioning a recording area of the recording medium, and a blower means for forming a flow of gas in the recording gap between the recording head and the recording area, the velocity of the flow of gas formed by the blower means being lower than the velocity of the ink droplet formed by the recording head.

12 Claims, 8 Drawing Sheets

INK JET RECORDING APPARATUS PROVIDED WITH BLOWER MEANS

This application is a continuation of application Ser. No. 08/147,423 filed Nov. 5, 1993, abandoned which in turn is a continuation of application Ser. No. 07/974,306 filed Nov. 10, 1992, abandoned which is a continuation of application Ser. No. 07/498,280 filed Mar. 23, 1990, all now abandoned.

BACKGROUND OF THE INVENTION

1. Field of the Invention

This invention relates to an ink jet recording apparatus provided with blower means, and particularly to an ink jet recording apparatus provided with means for positively blowing air to a recording area, and forming images on the surface of a recording medium by flying ink droplets.

The ink jet recording apparatus of the present invention covers an ink jet recording apparatus singly used or incorporated in or connected to an instrument such as a copying apparatus, a facsimile apparatus or a word processor, and all these recording apparatuses.

2. Related Background Art

Some of prior-art blower means are disposed around a carraige provided with an ink jet recording head and are moved with the recording head. For example, from U.S. Pat. No. 4,369,450 there is known a construction in which in an ink discharge area, air is blown in a direction similar to the direction of ink discharge and ink mist is sucked toward the carriage side. Conversely in U.S. Pat. No. 4,361,845, there is disclosed a construction in which ink mist is sucked by two suction ports located above an ink discharge area.

On the other hand, prior to these U.S. patents, U.S. Pat. No. 3,854,399 describes a construction in which air is applied to the printing area of a paper surface and a construction in which air is sucked, and discloses blower means fixed to an ink jet recording head of the continuous type.

Any of these is designed with a view to remove ink mist, but does not consider in detail the influence upon recording ink droplets themselves.

On the other hand, in Japanese Laid-Open Patent Application No. 62-218134 (U.S. application Ser. No. 319,878), there is shown a construction in which ink mist is sucked from both sides of a recording area and collected efficiently, but this neither gives consideration to the entire recording area. As regards the generation of such ink mist, in the ink jet recording of the on-demand type using the formation of bubbles by heat energy, much mist is generated by impact although the speed of ink droplets can be made high.

The present invention remarks the relation which has heretofore not been considered between the accuracy of shooting of recording liquid droplets and blower means for solving such problems as ink mist and condensation, and can achieve efficient collection of ink mist and prevention of condensation while accomplishing recording well.

Studies have been made while paying attention to the relation between ink mist adhering to the ink jet recording head and main recording ink droplets in order to reliably remove the ink mist in the entire recording area from the vicinity of the recording head to thereby prevent condensation without disturbing the recording ink droplets discharged from the ink jet recording head.

As a result, it has been found that the ink mist itself comprises minute drops separated from the final area of recording ink droplets and minute drops created by the rebound of the recording ink droplets occurring after the impact thereof against a recording medium such as paper and these irregularly move along a course differing from the course of the main recording ink droplets and that the size thereof is particularly irregular, i.e. under 1/20 of the size of the main recording ink droplets.

Also, ink jet recording apparatuses are divided broadly into the serial type and the full-line type, and in any of these types, if a suction stream or a supply stream by blast is formed in the gap between the recording head and the recording medium, at least a part of the record will be affected thereby. The pursuit of this has led to the discovery that the stream by the blast is varied in the recording area with a result that a turbulent flow is caused or there exists an area in which no effect of the blast is seen. This has been particularly conspicuous in the full-line type recorder.

On the other hand, in order to fixate ink shot onto a recording medium, there are constructions as disclosed in Japanese Laid-Open patent Application No. 54-156536 and Japanese Laid-Open Patent Application No. 54-156537 wherein hot air is utilized to dry the ink on the recording medium, and constructions as disclosed in Japanese Laid-Open Patent Application No. 62-130863 and Japanese Laid-Open Patent Application No. 62-130864 wherein the recording medium itself is heated to thereby dry and fixate the ink.

However, in the prior-art fixating means of the type as described above which utilizes hot air to dry the ink on the recording medium, particularly when it is carried out in a low-temperature atmosphere, a sufficient effect is not obtained and the heat of the hot air is taken away by the surrounding bodies kept at a low temperature and the recording medium, and satisfactory fixation has been difficult.

Also, the fixating means of the type in which the recording medium is heated by a heater to thereby fixate the ink has suffered from the inconvenience that where use is made of a recording sheet such as bond paper readily absorbing moisture, the interior of the apparatus is filled with steam provided by the moisture evaporating from the surface of the paper and the moisture evaporating from the recording ink and the steam becomes saturated and is condensed on the ink discharge surface of the recording head to cause non-discharge or twisted discharge of the ink. Particularly as regards the latter point, a greater attempt to keep the spacing between the ink discharge surface of the recording head and the recording medium narrow to improve the quality of recording has led to a more remarkable tendency toward condensation, and has sometimes resulted even in the impossibility of recording.

According to the inventor's studies, it is inferred that the generation of steam by fixation brings about the above-noted inconvenience due to the formation of water drops smaller than or equal in size to the aforedescribed mist and therefore, the inventor has pursued to prevent the inconvenience in fixation by blower means capable of achieving the prevention of the ink mist.

SUMMARY OF THE INVENTION

It is a primary object of the present invention to provide blower means capable of reliably removing ink mist and in addition, preventing condensation while recording in an ink jet recording apparatus is effected well.

It is another object of the present invention to provide blower means for preventing condensation on the recording head of an ink jet recording apparatus provided with fixating means and thereby preventing the occurrence of unsatisfactory recording.

It is still another object of the present invention to provide blower means capable of forming a steady flow to the entire recording area and moreover stabilizing recording.

It is yet still another object of the present invention to provide an ink jet recording apparatus in which ink mist created when use is made of a recording head capable of high-speed recording using heat energy can be removed from a recording area and which can fully display its recording performance.

Other objects of the present invention will become apparent from the following detailed description.

The typical constructions of the present invention may be enumerated as follows.

Firstly, according to an ink jet recording apparatus provided with ink jet recording means provided with a number of discharge portions for discharging ink droplets therethrough, recording medium conveying means for conveying a recording medium to which the ink droplets adhere and forming a recording area, and blower means for forming a flow of gas in the recording gap between said recording means and said recording area, the velocity of the flow of gas formed by said blower means being lower than the velocity of the ink droplet formed by said recording means, irrespective of the form of the recording apparatus, the recording ink droplet is large in volume and sufficient in velocity and therefore, recording can be stabilized and unnecessary ink mist and Steam can be reliably removed from the recording area.

The recording ink droplet, although differing depending on the recording means, usually becomes substantially one droplet, but in some cases, the recording ink droplet is separated into a plurality of droplets, i.e., a main ink droplet and ink droplets corresponding in size to ⅕ to 1/10 thereof and called satellites. In those recording heads utilizing heat energy which create film boiling, these satellites should originally be shot on the same position as the main ink droplet, and to prevent such performance from being disturbed, it is preferable to stably supply a flow of gas within a range of less than 2 m/sec. and greater than 5 cm/sec. In the case of an excellent recording head, droplets having a volume less than 1/20 of that of the ink droplet often provide ink mist and as a result of the pursuit of this, it has been found that if less than 50 cm/sec., the efficiency of removal of mist is high without being affected by the environment. Of course, under a stable environment, less than 25 cm/sec. is also sufficient and particularly, in the serial type, even less than 16 cm/sec. has resulted in good removal of mist. In this case, the recording ink droplets have not been disturbed and the recording means could fully display its performance. Of course, when use is made of piezo-electric which poorly affect the performance of the recording head, the satellites themselves become turbulent as ink mist and therefore, the main construction of the present invention can be adopted.

Also, in ordinary recording means using heat energy, the largest size of ink mist is less than ⅕ of the size of the main ink droplet and therefore, if the relative difference is within a range less than ⅕ of the velocity of the recording ink droplet and greater than 5 cm/sec., ink mist can be reliably removed without recording being disturbed.

Particularly, in order to stabilize the velocity of flow of the gas, for example, on both sides of the full-line recording width, relative to a large recording area, it is important to use the construction of an ink jet recording apparatus provided with ink jet recording means provided with a number of discharge portions for discharging ink droplets therethrough, recording medium conveying means for conveying a recording medium to which the ink droplets adhere and forming a recording area, and blower means for forming a flow of gas in the recording gap between said recording means and said recording area, said blower means being provided with a gas supply port located at one side with resepect to the direction of conveyance of the recording medium, and a gas suction port located at the other side, the velocity of the flow of gas formed by said blower means being lower than the velocity of the ink droplets formed by said recording means. According to this construction, a stable gas flow can be formed over the lengthwise direction and therefore, the reliability of the effect of removing ink mist can be more improved.

Also, according to the above-described ink jet recording head wherein said gas supply port and said gas suction port are opposed to each other with the recording area interposed therebetween and are located so that a main flow of gas may be formed near the path of said recording ink droplets, there is an advantage that the flow of gas can be relatively enhanced and moreover the problem of the recording ink droplets being disturbed can be drastically solved.

DESCRIPTION OF THE PREFERRED EMBODIMENTS

Some embodiments of the present invention will hereinafter be described in detail and specifically with reference to the drawings.

Figure 1:
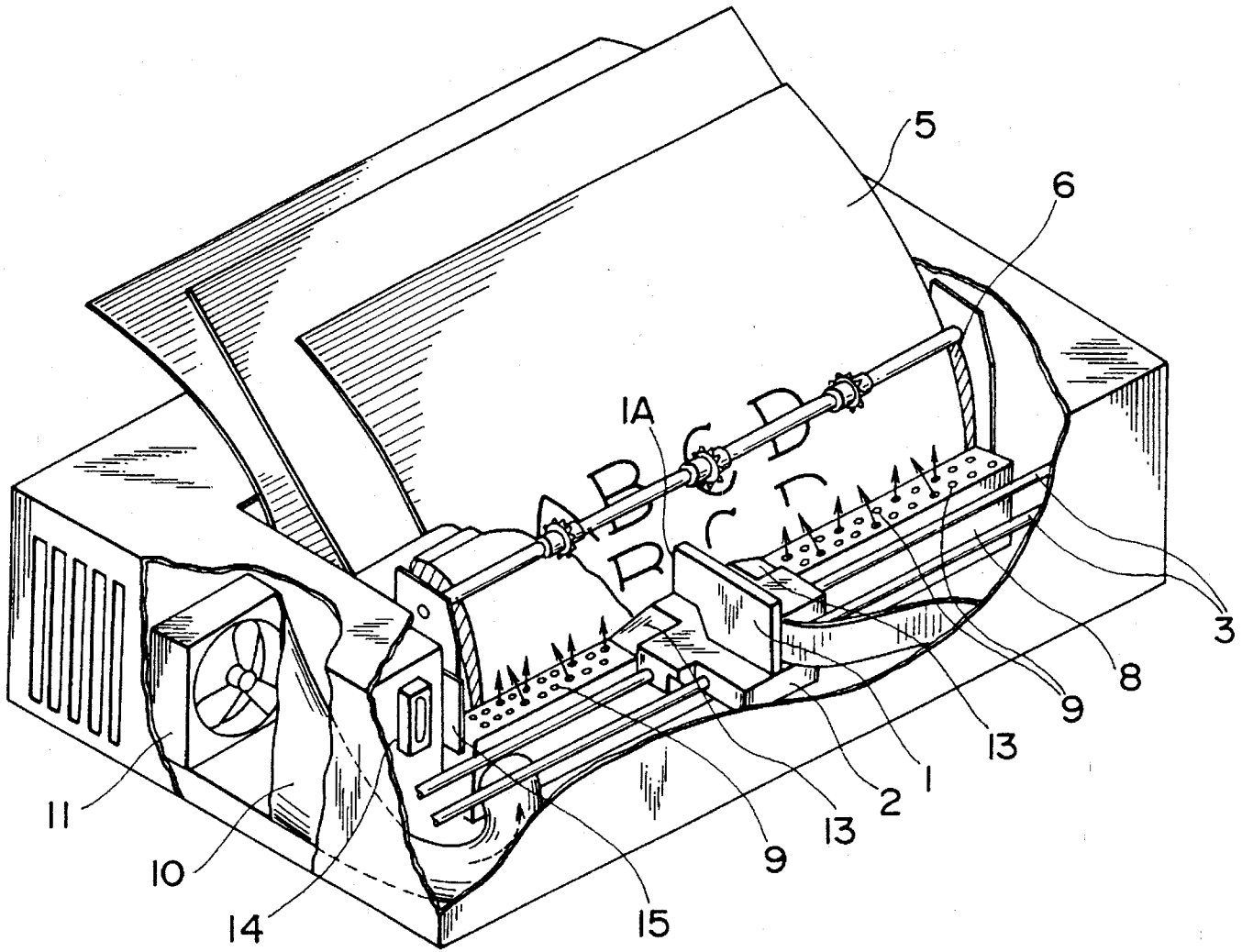
FIG. 1 is a perspective view showing an example of the construction of the ink jet recording apparatus of the present invention.
Figure 2:
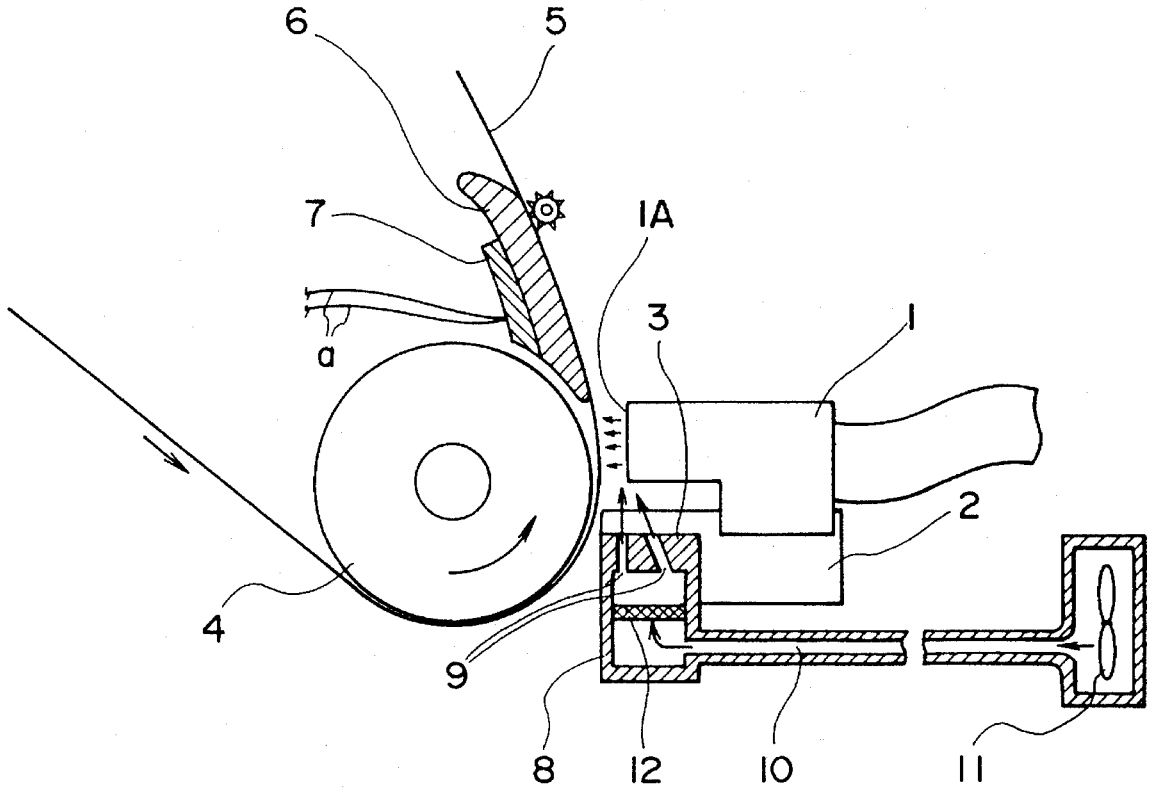
FIG. 2 is a cross-sectional view of the FIG. 1 apparatus.

FIGS. 1 and 2 show an embodiment of the present invention. In these figures, the reference numeral 1 designates an ink jet recording head carried on a carriage 2, the reference numeral 3 denotes guide shafts for slidably holding the carriage 2, the reference numeral 4 designates a friction roller for directing a recording medium 5 to a recording position, and the reference numeral 6 denotes a platen holding the recording medium 5 directed to the recording position and endowed with the function as fixating means for heating the recording medium 5 and effecting fixation (hereinafter referred to as the heat platen). The heat platen 6 has its front surface preferably subjected to surface treatment such as Teflon (registered trademark) coating in order to ensure good sliding effect relative to the conveyance of a recording sheet or paper for overhead projection (transmission or reflection type) which is the recording medium 5, and has its back surface provided with a heating element 7 such as an electric heater for heating as shown in FIG. 2. Lead wires a connected to a predetermined power source (not shown) are connected to the heating element 7 to electrically energize the latter. This also holds true in FIGS. 5 and 6.

The reference numeral 8 designates a blast duct provided substantially right beneath the recording head 1 over the scanning range of the recording head 1, the reference numeral 9 denotes a plurality of blast openings formed in the upper surface of the blast duct 8, and the reference numeral 10 designates a blast path for directing air from a blower fan 11 to the blast duct 8. The interior of the blast duct 8 is, for example, of such a construction in which there is provided a wall or the like which becomes progressively higher in the direction away from the blast openings 9 so that the air from the blast path 10 may be uniformly blown from the blast openings 9. Further, a filter 12 is provided in the blast duct 8 so that dust or the like may not mix with the air blown out from the blast openings 9. Thus, air is blown up as a strong wind from below toward the recording sheet 5 by the blower means and steam stagnating on the surface of the recording sheet is blown away, but if the air flows from below the recording head 1 directly along the ink discharge surface 1A of the recording head, an ink droplet discharged from an ink discharge opening, not shown, in the ink discharge surface 1A will be bent by the flow of the air and the shot position thereof will deviate, whereby the quality of recording will be spoiled.

So, in the present embodiment, shield plates 13 for shielding the blast openings 9 are provided on the carriage 2 so that the air may not be blown up near the recording head 1 along the ink discharge surface 1A, the under-surface of the shield plates 13 facing the blast openings 9 being substantially transversed to the air flow and the shape of the upper portion of the shield plates 13 is made into such a smooth shape that with the leftward and rightward movement of the carriage 2, there is created no turbulent air flow, whereby normal flight of the ink droplet may not be impeded. This shape can vary such that the shot position of the discharged ink droplet does not deviate, and further, a member, for example, a wall member, may be provided on a side of the head to thereby achieve the aforedescribed purpose. As shown in FIG. 1, the shield plates 13 are disposed closer than the ink discharge surface 1A to the blast opening 9. Therefore, the shield plates 13 are provided upstream of the discharge surface 1A with respect to the direction of the flow of air from the blast opening 9. Furthermore, in FIG. 1, the reference numeral 14 designates recovery means for preventing the clogging of the recording head 1, and the reference numeral 15 denotes a wiper for wiping the ink discharge surface 1A.

In the ink jet recording apparatus constructed as described above, wet air is blown away from the surface of the recording medium 5 by the blower means before and after recording. Particularly, the steam heated by the heat platen 6 and evaporated from the recording medium 5 is blown upwardly, whereby the desiccation and fixation of the ink is expedited and such steam can be prevented from adhering to and being condensed on the recording head 1 to impede recording.

The inventor carried out comparative experiments of recording by the use of a prior-art ink jet recording apparatus having only a heat platen mounted therein and the ink jet recording apparatus according to the above-described embodiment, and as a result, obtained the observation evaluation as shown in Table 1 below.

TABLE 1

| Condensation on the Recording Head Discharge Surface and Evaluation of Recording | | | | |
|---|---|---|---|---|
| | Spacing between recording head and recording medium | | | |
| | 0.8 mm | 1.5 mm | 2.5 mm | Remarks |
| Prior Art (heat platen only) | XX remarkable condensation | X condensation | Δ(*1) slight condensation | Quality of recording is deteriorated at *1 (increased in amount of twist) |
| Present Embodiment (heat platen + blower means) | ○ very little condensation | ○ | — | |

As is apparent from Table 1, according to the present embodiment, there was seen very little condensation on the discharge surface 1A with a proper spacing kept between the recording head 1 and the recording medium 5. In contrast, as a result of recording having been effected in the full discharge mode by the prior-art recording apparatus, as shown also in FIG. 3, condensation 20 was seen extensively near the ink discharge openings 1B in the ink discharge surface 1A, and in the recording head when in such a state, non-discharge occurred. That is, in such a state, the moisture condensed during the recording operation sways to the right and left as the head is moved, and comes to clog the ink discharge openings 1B and impede the discharge, thereby bending the direction of discharge or causing non-discharge.

Further, paper powder, dust, etc. adhering to the ink discharge surface 1A may sometimes be directed to the discharge openings 1B by condensed moisture to even clog the discharge openings 1B, but according to the present invention, as can be seen from the experiment carried out on the above-described embodiment, the direction of discharge and non-discharge can be prevented by preventing condensation, thereby ensuring stable ink discharge to be accomplished.

Figure 4:
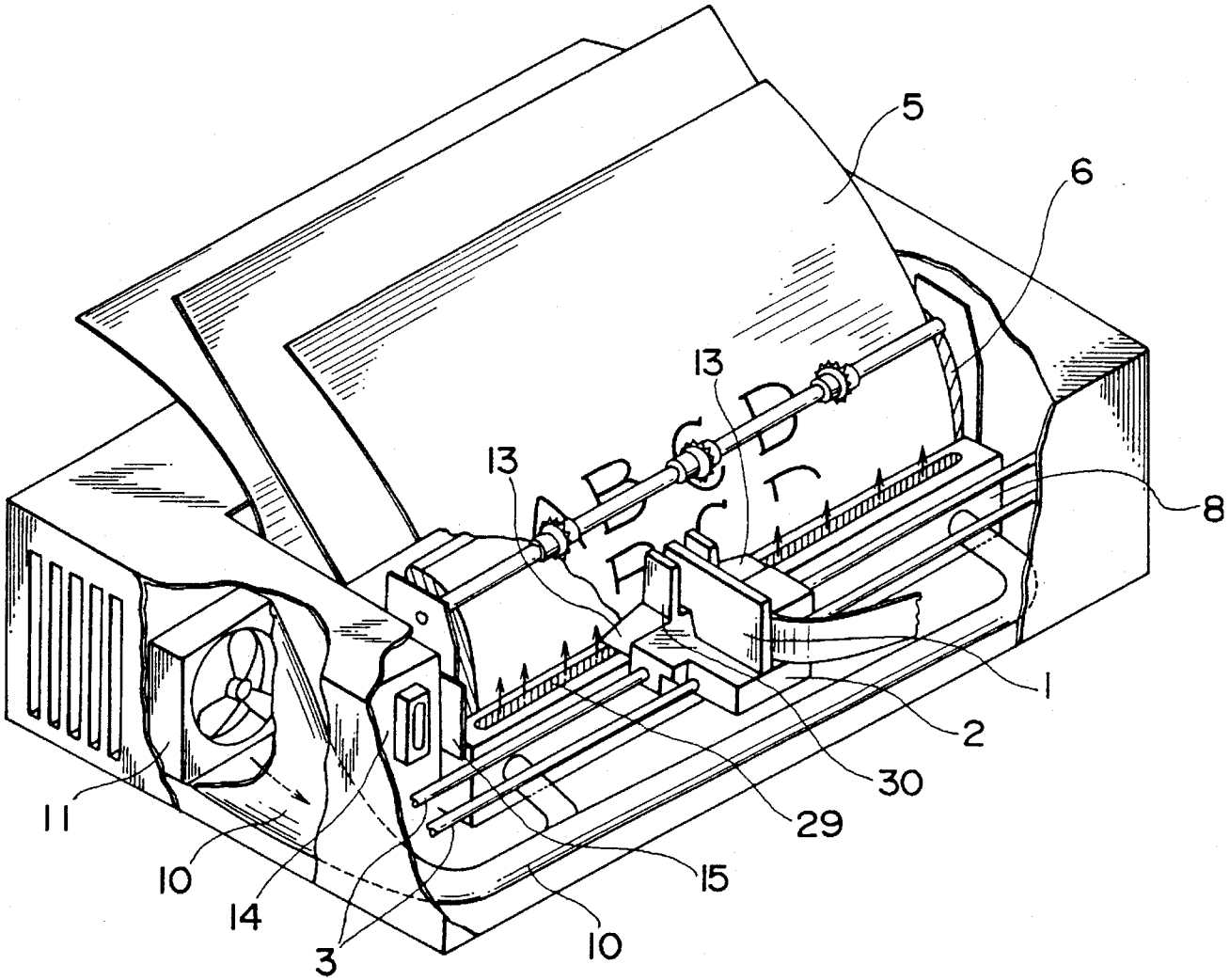
FIG. 4 is a perspective view showing the construction of another embodiment of the present invention.

FIG. 4 shows another embodiment of the present invention. In this embodiment, a blast opening 29 provided in the blast duct 8 is formed as a continuous elongated opening over the entire scanning area of the recording head 1, and the interior of the blast duct 8 is worked so that air may be blown out as uniformly as possible from this elongated blast opening 29, and in addition, in the present embodiment, blast paths 10 are connected to the opposite ends of the blast duct 8. The elongate opening may also be worked in a mesh-like form, whereby further uniformization of the blast can be achieved. Further, in the present embodiment, shield plates 13 and shield plates 30 are vertically provided on the right and left sides of the recording head 1 so that ink droplets discharged from the discharge openings 1B may not be affected by the air blown out from the blast opening 29 and the oscillation of the air caused by movement of the carriage 2 while the ink droplets are flying. The effect of preventing condensation on the ink discharge surface 1A and the effect of expediting fixation during the recording by the ink jet recording apparatus thus constructed are similar to what has been described previously and need not be described.

In the above-described embodiments, air is blown from right beneath the recording head, but an air flow may be created from sideways of the recording head, and various modifications are possible if they satisfy the purpose of the present invention. However, blowing the air from below the recording head permits the steam component present between the head and the platen to escape more readily and can eliminate the temperature rise of the head itself.

As has been hitherto described, according to the present embodiment, in the ink jet recording apparatus wherein a fixating means for heating and fixating the ink shot onto the recording medium is provided in association with the platen, blower means for supplying air from below the scanning area of the recording head toward the direction of feeding of the recording medium is provided over the entire scanning area and therefore, steam evaporated from the recording medium by the heating and fixating means can be prevented from being condensed on the ink discharge surface of the recording head, and the ink discharging function is not spoiled in a low-temperature atmosphere as well as in a high-temperature and high-humidity atmosphere and thus, sufficient fixation and recording of high quality can be achieved.

Also, the supplied air is shielded so as not to be directed directly to the ink discharge surface of the recording head, whereby there is no possibility of twisted print, and by the surface of the recording medium being blown off, paper powder and paper fuzz can be suppressed from adhering to the ink discharge surface.

Figure 5:
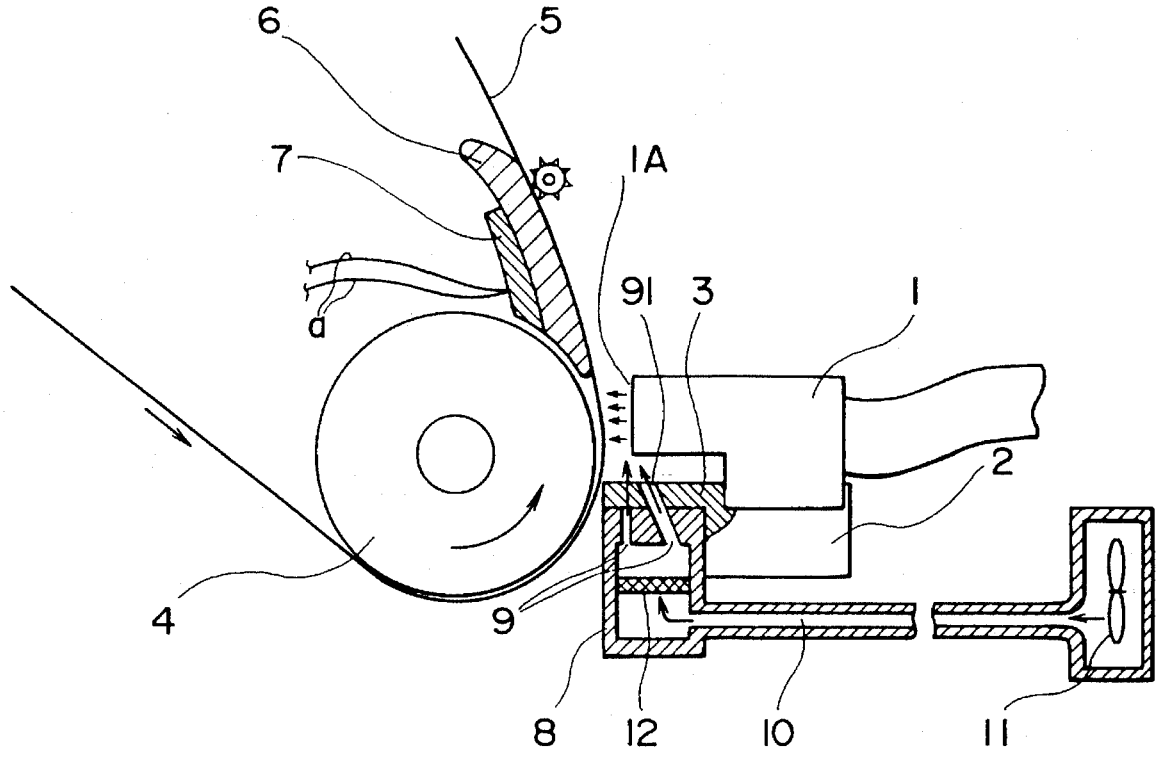
FIG. 5 is a cross-sectional view showing a modified construction of the embodiment of FIGS. 1 and 2.
Figure 6:
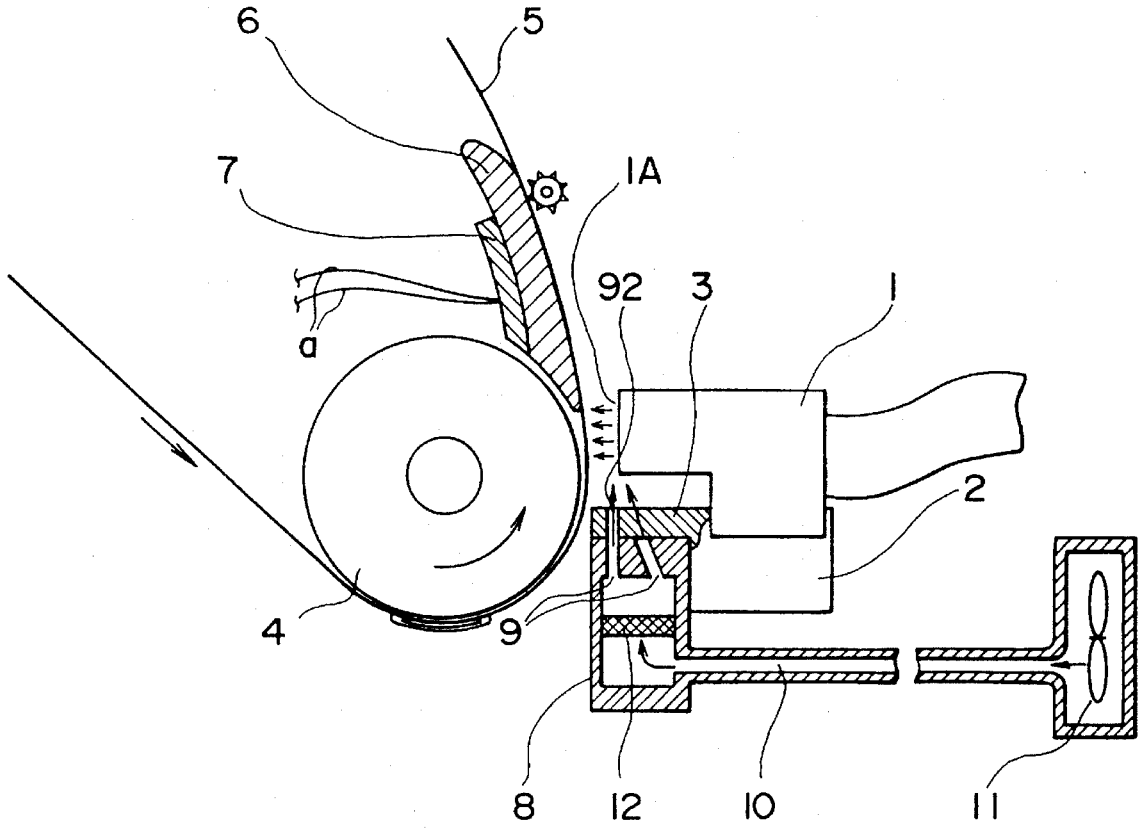
FIG. 6 is a cross-sectional view showing another modified construction of the embodiment of FIGS. 1 and 2.

FIGS. 5 and 6 show partly improved embodiments of the constructions of FIGS. 1 and 4.

Figure 3:
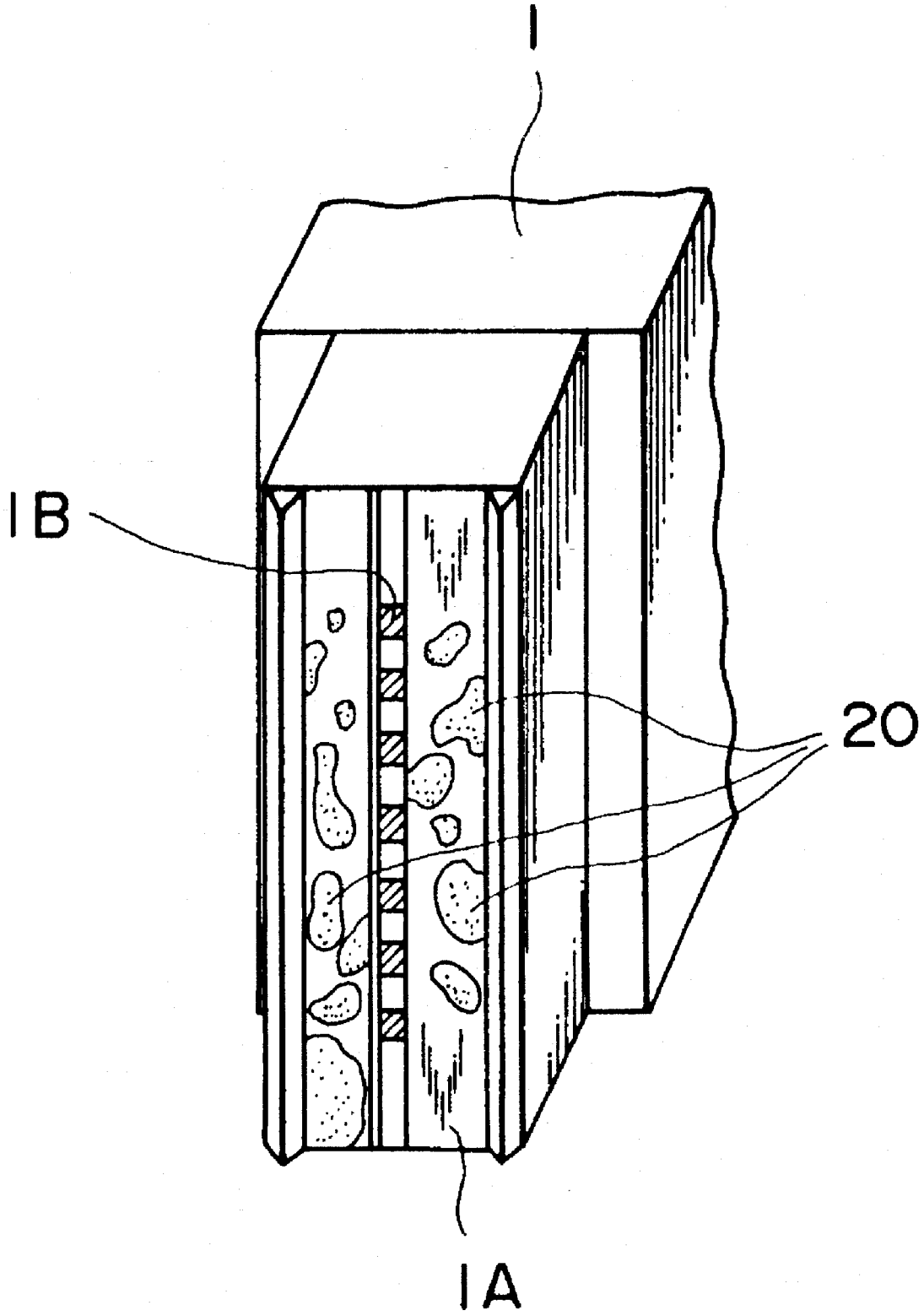
FIG. 3 is a perspective view schematically showing the state of condensation on the ink discharge surface of a recording head in an ink jet recording apparatus according to the prior art.

In the embodiments of FIGS. 1 and 4, the blast by the blower means, even if it is a considerably strong wind, is intercepted on the way to the recording area by the shield plates 13 and therefore, unsatisfactory recording does not take place and the performance of the serial type ink jet recording apparatus is satisfied. However, if a plurality of recording heads are employed to increase the shield area provided by the shield plates 13, the accumulation of ink mist created in the recording area will increase the cause of the inconvenience as shown in FIG. 3, and if a change to high density such as an increase in the number of the discharge portions of the recording heads from 84 to 168 progresses, the shield plates will become imperfect to the accumulation of ink mist.

FIGS. 5 and 6 show constructions which can accomplish recording satisfactorily while achieving a countermeasure for such ink mist. That is, in FIG. 5, a slit 91 (a blast permitting portion) is formed in the carriage 2 so that of two rows of blast openings 9, the blast opening for forming an air flow impinging on the lower portion of the recording head 1 can always be opened. The air passing through this slit 91 forms a weak gas flow (in the present embodiment, a flow which is at a velocity lower than the discharge velocity 8 m/sec. of the ink droplet from the ink discharge surface and at 1 m/sec. in the recording gap after decelerating by impinging on the lower portion of the head) in the recording gap during both the movement and the stoppage of the carriage 2. Thereby, only the ink mist is reliably directed upwardly from the recording gap without disturbing the discharge of the recording ink, thus preventing the adherence thereof to the ink discharge surface.

Conversely, in the embodiment of FIG. 1, the blast permitting portion of the carriage 2 is provided for the blast openings 9 for forming an air flow directly blown to the recording gap. This permitting portion is a slit 92 in the figure. This slit 92 forms a stable gas flow of 2 m/sec. in the recording gap. Forming a stable air flow at a velocity of flow of 2 m/sec. or less, preferably 1 m/sec. or less, in the recording gap can not only reliably remove ink mist from this gap, but also can achieve stable fixation and prevention of condensation without greatly disturbing the velocity of the recording ink droplet. In the present embodiment, the recording gap is 1 mm or less and therefore, the velocity of flow of the air may optimally be less than 2 m/sec. and greater than 50 cm/sec.

The inventor has studied the range within which the above-described effects are achieved not by the conventional method whereby a strong wind is imparted to the whole of the serial type recording area, and has ascertained that it is not necessary to make the velocities of flow in the recording gap between the recording head and the paper and in the other portions different from each other as in the above-described embodiments. That is, in the full width of the recording area, the velocity of a stable gas flow is made lower than the discharge speed (usually 8 m–10 m/sec.) of the recording ink droplet, preferably 2 m/sec. or less (where the heating and fixating area is provided above the recording area, 1 m/sec. or less is preferable), whereby the desired effects of the above-described embodiments could be obtained. In this case, in spite of the irregularity of the characteristic of the recording head 1, the accuracy of shot of recorded images was visually quite good.

FIGS. 7 to 10 illustrate further embodiments of the present invention. The reference numeral 40 designates a recording head of the full-line head type capable of printing over the maximum width with respect to the direction of conveyance of the recording medium 5 and having a number of electro-thermal converting members for causing film boiling by heat energy correspondingly to a number of discharge openings 41 (3,000 or more). The recording head 40 is temperature-regulated to the order of 40° C.–50° C. by ordinary temperature regulating means (not shown). The reference numeral 55 denotes discharge path of ink droplets from the discharge openings 41 in the recording head 40. The discharge path 55 can form a printing line 56. The reference numeral 42 designates a smooth endless rotatable belt for electrostatically attracting and conveying the recording medium 5. The belt 42 is uniformly charged by a charger 53 and attracts and conveys the supplied recording medium. The reference numerals 43 and 44 denote rollers for rotating the belt 42.

The reference numeral 45 designates a supply port for supplying the gas from gas supplying means 49 to the downstream side of the recording area through a pipe 50. The reference numeral 46 denotes a suction port opposed to the supply port 45 and sucking the gas in the recording area. The suction port 46 receives the suction force from suction means 48 through a pipe 47. That is, a gas flow is supplied lengthwisely of the recording area from the supply port 45 on one side of the recording area and a gas flow by suction is formed lengthwisely of the recording area from the suction port 46 on the other side of the recording area.

This construction is particularly effective in the case of an elongated recording head, but suction ports opposed to the blast openings 9 of the previously described serial type construction may be provided to achieve further stabilization of the air flow. The advantage of this construction will now be described with reference to FIG. 9. When an attempt is made to obtain a velocity of flow higher than a desired level over the entire elongated area, there may be a great difference in velocity of flow between the vicinity of the supply port or the suction port and a position far from it due to the air resistance, which and may cause a turbulent flow. Therefore, to form a stable gas flow uniformly in the entire elongate area, there is obtained a construction in which a supply port and a suction port are provided on the opposite sides of the elongated area to prevent the creation of a turbulent flow by the combined effect of the ports.

Figure 9:
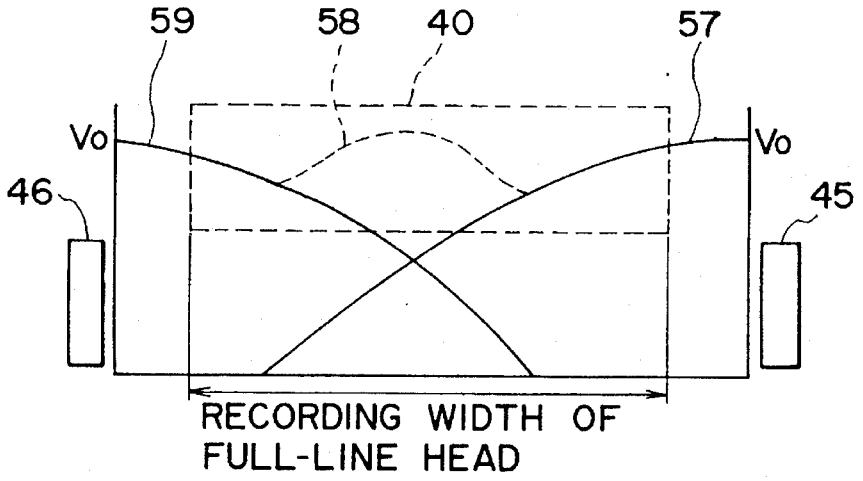
FIG. 9 shows the distribution of blast in FIG. 7.

In FIG. 9, curve 57 shows a variation in the velocity of flow of gas when only a gas flow at a velocity of flow $V_0$ is supplied from the supply port 45. As can be seen from the curve 57, the velocity of flow decreases significantly at the halfway point of the full-line recording width and the flow becomes substantially null. Conversely, curve 59 shows a variation in the velocity of flow of gas when an attempt is made to form a gas flow at a velocity of flow $V_0$ from only the suction port 46. This also exhibits a tendency similar to the curve 57. If an attempt is made to form a desired velocity of flow or higher in the entire recording area of the full-line recording head 40 by only one of these, the means 48 and 49 of the power generation source will become bulky and the difference in the variation in velocity of flow will become great. This will tend to form a turbulent flow in the end area of the recording head and therefore, in the case of a considerably long elongated head, it will be preferable to make the supply port 45 and the suction port 46 opposed to each other and output the gas at a time. In the case of the present embodiment, when the respective velocities of flow $V_0$ were formed, a velocity of flow substantially equal to $V_0$ could be obtained in the central area of the recording head due to the mutual action, as shown by curve (broken line) 58. This means that a gas flow is reliably imparted as a stable flow to the central area of the recording head in which ink mist concentrates and therefore, it is apparent that this construction is excellent in the effect of removing ink mist and the effect of preventing condensation.

By setting the velocity of flow $V_0$ in this case to a value smaller than the velocity of ink discharge, preferably, to 2 m/sec. or less, unsatisfactory recording can be prevented. In the present embodiment, the characteristic of the recording head is good and therefore, removal of unnecessary droplets which provide ink mist could be sufficiently accomplished simply by setting the velocity of flow to ⅕ or less of the velocity of ink discharge, preferably 1 m/sec. or less, and more preferably less than 50 cm/sec. and greater than 5 cm/sec., and it was not necessary to remove satellite droplets, and this could also contribute to the stabilization of images.

Figure 7:
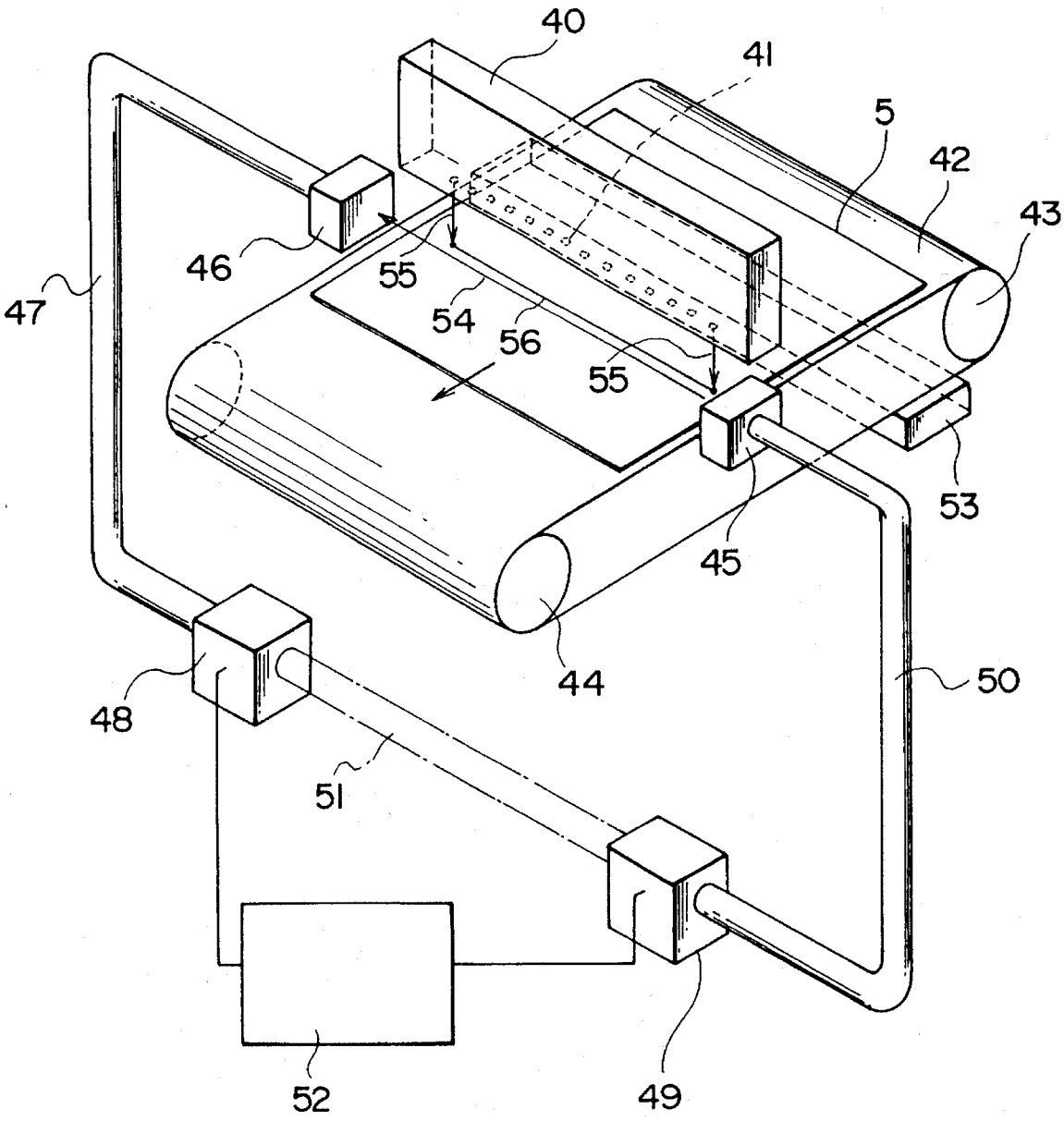
FIG. 7 illustrates still another embodiment of the ink jet recording apparatus of the present invention.
Figure 8:
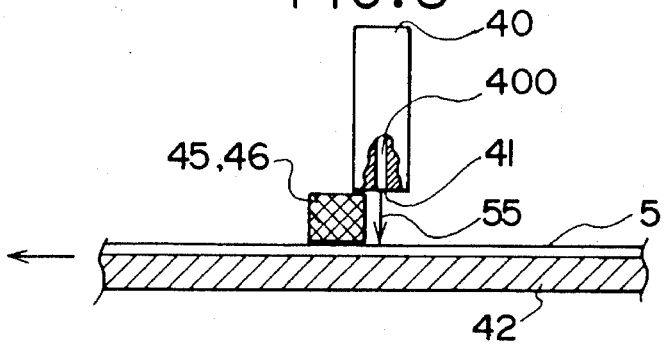
FIG. 8 is a side view showing the essential portions of the FIG. 7 apparatus.

As regards the opposed locations of the suction port 46 and the supply port 45 in FIG. 7, these ports should preferably be provided off and near the discharge path 55 because ink mist tends to concentrate in the slightly downstream side of the discharge path 55 as the recording medium 5 is continuously moved. It is FIG. 8 that shows this relation. In FIG. 8, the reference numeral 400 designates the aforementioned electro-thermal converting member, and the reference numeral 41 denotes a discharge opening. By the suction port and the supply port being disposed off the discharge path 55, the velocity of flow of gas can be made free from the influence of ink discharge and the accuracy of shot in recording can be made more stable.

Figure 10:
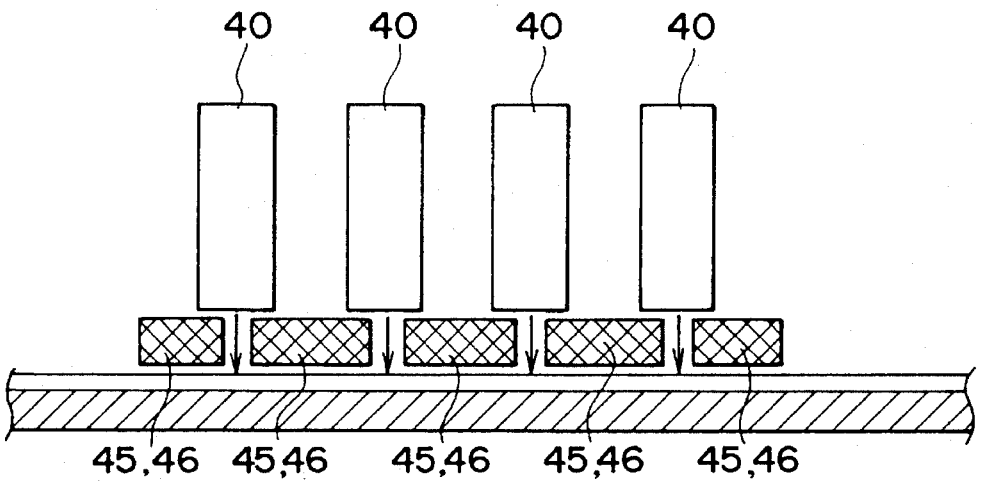
FIG. 10 is a side view showing the essential portions of yet still another embodiment of the ink jet recording apparatus of the present invention.

FIG. 10 shows a case where four (i.e., a plurality of) full-line recording heads 40 are provided as different recording heads for ink droplet formation. Since ink mist itself has a coloring property, the tendency thereof to adhere to heads of other colors results in a color mixture and makes a desired image color unclear. Therefore, in the present embodiment, a pair of supply port 45 and suction port 46 as shown in FIG. 8 are also provided between the adjacent recording heads to thereby make it possible for the ink mist from each recording head to be removed from both the upstream side and the downstream side thereof. It is important that the directions of these gas flows are the same. This is because if these directions differ from one another, ink mist may concentrate in the recording gap. In the present embodiment, the supply ports and suction ports between the plurality of heads are made common and slightly large, but alternatively, each of these may be divided into a plurality. It is preferable that the velocity of flow in this case also satisfy the aforementioned conditions.

In FIGS. 8 and 10, the supply ports and suction ports for gas flow formation are provided avoiding the ink discharge path 55, but since a route for reliably removing ink mist and steam can be formed while the accuracy of shot of recording ink droplets remains maintained by the formation of a stable flow of less than 2 m/sec. as previously mentioned, preferably 50 cm/sec., a construction including the path 55 may of course be adopted.

The broken lines 51 in FIG. 7 indicate a connecting pipe, and this suggests that supply means 49 is connected to suction means 48 and one of these means 48 and 49 is eliminated. By this connection, the blast efficiency is improved and the pump itself can be made compact.

The reference numeral 52 designates control means for operating the means 48 and 49 before the start of recording to form the above-described steady flow, and controlling them so as to form a gas flow in advance.

The present invention brings about an excellent effect particularly in a recording head and a recording apparatus of the bubble jet type among the ink jet recording types.

As regards the typical construction and principle thereof, it is preferable to use the basic principle disclosed, for example, in U.S. Pat. No. 4,723,129 or U.S. Pat. No. 4,740,796. This system is applicable to both of the so-called on-demand type and the so-called continuous type, and in the case of the on-demand type, it is particularly effective because at least one driving signal corresponding to recording information and providing a rapid temperature rise exceeding nuclear boiling is applied to an electro-thermal converting member correspondingly to a sheet or a liquid path retaining liquid (ink) therein, whereby heat energy is generated in the electro-thermal converting member and film boiling is caused on the heat-acting surface of a recording head with a result that a bubble in the liquid (ink) can be formed in one-to-one correspondence to said driving signal. By the growth and contraction of this bubble, the liquid (ink) is discharged through a discharge opening to form at least one droplet. If this driving signal is in the form of a pulse, the growth and contraction of the bubble will take place appropriately on the spot and therefore, discharge of the liquid (ink) which is particularly excellent in responsiveness can be accomplished, and this is more preferable. As the driving signal in the form of a pulse, one as described in U.S. Pat. No. 4,463,359 or U.S. Pat. No. 4,345,262 is suitable. If the conditions described in U.S. Pat. No. 4,313,124 which discloses an invention relating to the temperature rise rate of said heat-acting surface are adopted, more excellent recording can be accomplished.

As the construction of the recording head, besides the construction comprising a combination of discharge openings, liquid paths and electro-thermal converting members as disclosed in each of the above-mentioned patents (the straight liquid flow path or the right-angled liquid flow path), a construction using U.S. Pat. No. 4,558,333 or U.S. Pat. No. 4,459,600 which discloses a construction in which the heat-acting portion is disposed in a bent area is also covered by the present invention. In addition, the present invention is effective for a construction based on Japanese Laid-Open Patent Application No. 59-123670 which discloses a construction in which a slit common to a plurality of electro-thermal converting members is the discharge portion of the electro-thermal converting members, and a construction based on Japanese Laid-Open Patent Application No. 59-138461 which discloses a construction in which an opening for absorbing the pressure wave of heat energy corresponds to the discharge portion.

Further, the full-line type recording head having a length corresponding to the width of the largest recording medium on which the recording apparatus can effect recording may assume any of the constructions as disclosed in the above-mentioned publications wherein that length is satisfied by a combination of a plurality of recording heads and a construction as a single recording head which is formed as a unit, and the present invention can display the above-described effect more effectively.

Also, the addition of recovery means, preliminary auxiliary means, etc. to the recording head which are provided as the construction of the recording apparatus of the present invention can more stabilize the effect of the present invention, and therefore is preferable. Specifically mentioning these, they include capping means, cleaning means and pressurizing or suction means for the recording head, an electro-thermal converting member or a heating element discrete therefrom or preliminary heating means comprising a combination of these, and it is also effective for accomplishing stable recording to perform the preliminary discharge mode in which discharge discrete from recording is effected.

Further, the recording mode of the recording apparatus is not limited to the recording mode of the main color such as black, but the present invention is also very effective for an apparatus provided with at least one of a plurality of different colors or the full color by a color mixture, though this may be accomplished by constructing the recording head as a unit or employing a combination of a plurality of recording heads.

What is claimed is:

1. An ink jet apparatus having an ink jet head for discharging ink onto a recording medium to record, said apparatus comprising:

a conveyance route for conveying the recording medium, said conveyance route including heating and fixing means for fixing ink deposited on the recording medium;

a carriage scanning along the scanning route adjacent the recording medium the ink jet head mounted thereon;

blower means, provided at an area along the scanning route of said carriage, for generating an air flow in a direction parallel to a surface of the recording medium between the ink jet head and the recording medium; and a shielding member provided in the vicinity of the ink jet head and upstream and downstream of the ink jet head with respect to a scanning direction of said carriage and moving along with said carriage, said shielding member comprising at least one surface transverse to the direction of the air flow for shielding the ink jet head from the air flow of said blower means.

2. An ink jet apparatus according to claim 1, wherein the velocity of the flow of air is less than 2 m/sec. and greater than 5 cm/sec.

3. An ink jet apparatus according to claim 2, wherein the velocity of the flow of air is less than 50 cm/sec. and greater than 5 cm/sec.

4. An ink jet apparatus according to claim 3, wherein the velocity of the flow of air is less than 25 cm/sec. and greater than 5 cm/sec.

5. An ink jet apparatus according to claim 4, wherein the velocity of the flow of air is less than 16 cm/sec. and greater than 5 cm/sec.

6. An ink jet apparatus having an ink jet head for discharging ink onto a recording medium to record, said apparatus comprising:

a conveyance route for conveying the recording medium, said conveyance route having heating and fixing means for fixing ink deposited on the recording medium;

a carriage scanning along a scanning route adjacent the recording medium with the ink jet head mounted thereon;

blower means, provided at an area along the scanning route of said carriage, for generating an air flow in a direction parallel to a surface for the recording medium between the ink jet head and the recording medium, the speed of the air flow being no more than one-fifth of a flying speed of an ink droplet discharged from the ink jet head and at least 5 cm/sec; and a shielding member provided in the vicinity of the ink jet head and upstream and downstream of the ink jet head with respect to a scanning direction of said carriage and being integral with said carriage, said shielding member comprising at least one surface transverse to the direction of the air flow for shielding the ink jet head from the air flow of said blower means.

7. An ink jet apparatus according to claim 6, wherein the velocity of the flow of air formed by said blower means is less than 50 cm/sec. and greater than 5 cm/sec.

8. An ink jet apparatus comprising:

a conveyance route for conveying the recording medium, said conveyance route including heating and fixing means for fixing ink deposited on the recording medium;

carriage for mounting an ink jet head thereon, said carriage scanning along a scanning route adjacent the recording medium;

a blower section for generating an air flow in a direction parallel to a surface of the recording medium between the ink jet head and the recording medium, said blower section being provided at an area along the scanning route of said carriage; and a shielding member provided in the vicinity of the ink jet head and upstream and downstream of the ink head with respect to a scanning direction of said carriage and moving along with said carriage, said shielding member comprising at least one surface transverse to the direction of the air flow for shielding the ink jet head from the air flow of said blower section.

9. An ink jet apparatus according to claim 8, wherein the velocity of the flow of air is less than 2 m/sec. and greater than 5 cm/sec.

10. An ink jet apparatus according to claim 9, wherein the velocity of the flow of air is less than 50 cm/sec. and greater than 5 cm/sec.

11. An ink jet apparatus according to claim 10, wherein the velocity of the flow of air is less than 25 cm/sec. and greater than 5 cm/sec.

12. An ink jet apparatus according to claim 8, wherein the ink jet head comprises an electro-thermal converting member for forming ink droplets by heat energy.

* * * * *

UNITED STATES PATENT AND TRADEMARK OFFICE

CERTIFICATE OF CORRECTION

PATENT NO. : 5,528,271
DATED : June 18, 1996
INVENTOR(S) : Isao EBISAWA

It is certified that error appears in the above-indentified patent and that said Letters Patent is hereby corrected as shown below:

COLUMN 3:

Line 30, "Steam" should read --steam--.

COLUMN 11:

Line 58, "medium" should read --medium with--.

COLUMN 12:

Line 31, "surface for" should read --surface of--;
Line 54, "carriage" should read --a carriage--;
Line 65, "ink" should read --ink jet--.

Signed and Sealed this

Twenty-ninth Day of October 1996

*Attest:*

Bruce Lehman

BRUCE LEHMAN

*Attesting Officer*

*Commissioner of Patents and Trademarks*